US007014811B2

(12) United States Patent
Harimoto et al.

(10) Patent No.: US 7,014,811 B2
(45) Date of Patent: Mar. 21, 2006

(54) METHOD FOR PRODUCING RARE EARTH SINTERED MAGNETS

(75) Inventors: Daisuke Harimoto, Osaka (JP); Yuji Kaneko, Uji (JP); Akira Nakamura, Ibaraki (JP)

(73) Assignee: Neomax Co., Ltd., Osaka (JP)

( * ) Notice: Subject to any disclaimer, the term of this patent is extended or adjusted under 35 U.S.C. 154(b) by 378 days.

(21) Appl. No.: 10/381,184

(22) PCT Filed: Jun. 25, 2002

(86) PCT No.: PCT/JP02/06368

§ 371 (c)(1),
(2), (4) Date: Mar. 21, 2003

(87) PCT Pub. No.: WO03/005383

PCT Pub. Date: Jan. 16, 2003

(65) Prior Publication Data

US 2003/0178103 A1 Sep. 25, 2003

(30) Foreign Application Priority Data

Jul. 2, 2001 (JP) ..... 2001-200375

(51) Int. Cl.
*B22F 3/12* (2006.01)

(52) U.S. Cl. ..... 419/12; 419/38; 148/101; 148/103; 148/104; 75/244; 75/246

(58) Field of Classification Search ..... 419/12, 419/38; 148/101, 103, 104; 75/244, 246
See application file for complete search history.

(56) References Cited

U.S. PATENT DOCUMENTS

| | | | | |
|---|---|---|---|---|
| 4,770,723 | A | 9/1988 | Sagawa et al. | |
| 4,792,368 | A | 12/1988 | Sagawa et al. | |
| 4,818,305 | A * | 4/1989 | Steingroever | 148/103 |
| 5,383,978 | A | 1/1995 | Yamamoto et al. | |
| 5,958,285 | A | 9/1999 | Kawano et al. | |
| 6,461,565 | B1 * | 10/2002 | Tokuhara et al. | 419/38 |
| 6,464,931 | B1 | 10/2002 | Oota et al. | |
| 6,548,014 | B1 * | 4/2003 | Kumokita et al. | 419/37 |
| 6,649,124 | B1 * | 11/2003 | Kohara et al. | 419/38 |

FOREIGN PATENT DOCUMENTS

| | | |
|---|---|---|
| CN | 1258919 A | 7/2000 |
| JP | 58-141305 | 8/1983 |
| JP | 61-119009 | 6/1986 |
| JP | 61-125114 | 6/1986 |
| JP | 61-221304 | 10/1986 |
| JP | 4-154903 | 5/1992 |
| JP | 7-161560 | 6/1995 |
| JP | 07-226328 | 8/1995 |
| JP | 10-270276 | 10/1998 |
| JP | 11-71174 | 3/1999 |
| JP | 2000-315611 | 11/2000 |

* cited by examiner

*Primary Examiner*—John P. Sheehan
(74) *Attorney, Agent, or Firm*—Keating & Bennett, LLP

(57) ABSTRACT

A method for producing rare earth sintered magnets includes the steps of pressing and compacting an alloy powder for the rare earth sintered magnets, thereby preparing a plurality of green compacts, arranging the green compacts on a receiving plane in a direction in which a projection area of each of the green compacts onto the receiving plane is not maximized, and heating the green compacts, thereby sintering the green compacts and obtaining a plurality of sintered bodies.

9 Claims, 4 Drawing Sheets

METHOD FOR PRODUCING RARE EARTH SINTERED MAGNETS

TECHNICAL FIELD

The present invention relates to a method for producing rare earth sintered magnets.

BACKGROUND ART

Rare earth sintered magnets currently used extensively in various fields of applications include a samarium-cobalt (Sm—Co) type magnet and a neodymium-iron-boron type magnet (which will be herein referred to as an "R-T-(M)-B type magnet"). Among other things, the R-T-(M)-B type magnet (where R is at least one of the rare earth elements including yttrium (Y) and is typically neodymium (Nd), T is either Fe alone or a mixture of Fe, Co and/or Ni, M is at least one additive selected from the group consisting of Al, Ti, Cu, V, Cr, Ni, Ga, Zr, Nb, Mo, In, Sn, Hf, Ta and W, and B is either boron alone or a mixture of boron and carbon), is used more and more often in various types of electronic appliances. This is because the R-T-(M)-B type magnet exhibits a maximum energy product $(BH)_{max}$ that is higher than any of various other types of magnets, and yet is relatively inexpensive.

A rare earth sintered magnet is produced by pulverizing a rare earth alloy into an alloy powder, pressing and compacting the alloy powder under a magnetic field to obtain a green compact (as-pressed compact) and then sintering the green compact in a sintering furnace. If the rare earth element such as neodymium to be included in the R-T-(M)-B type magnet is oxidized during the sintering process, the resultant magnetic properties deteriorate significantly. Thus, to avoid the disadvantageous oxidation, the atmosphere inside the sintering furnace is normally a vacuum or a reduced-pressure inert atmosphere of Ar, He, or any other inert gas. In sintering multiple green compacts, those green compacts are loaded into a hermetically sealable sintering case (which is also called a "sintering pack") and then the sintering case, including those green compacts, is heated in its entirety to increase the productivity. Also, when a great number of green compacts are to be sintered simultaneously, a sintering case, equipped with a number of sintering base plates piled up like shelves, is used. In that case, the as-pressed green compacts are arranged on the sintering base plates and then those plates are stored like shelves inside the sintering case.

For example, green compacts 95 to be processed into sintered magnets for a motor are sintered after having been arranged inside a sintering case 9 as shown in FIGS. 3A and 3B.

In the example illustrated in FIGS. 3A and 3B, the sintering case 9 includes a bottom container 90 and a cover 92 to be fitted with the bottom container 90. The bottom container 90 includes a bottom plate 90*a* and a sidewall 90*b*. Inside the bottom container 90, a number of sintering base plates 94 are vertically piled up with a predetermined gap provided between them by spacers 96. The sintering case 9 is heated up to an elevated temperature of about 1,000° C. or more, for example, during the sintering process. Accordingly, the bottom container 90 and the cover 92 are both made of a material with high thermal resistance (e.g., molybdenum or SUS310).

The sidewall 90*b* of the bottom container 90 surrounds the periphery of the sintering base plates 94 and supports the cover 92 thereon at the upper edge thereof. The space surrounded with the sidewall 90*b* (i.e., storage space) has a horizontal dimension (i.e., a width) that is slightly greater than the width of the sintering base plates 94. The difference may be on the order of several millimeters to several centimeters. In any case, this sintering case 9 is designed so as to have a narrow gap between the sintering base plates 94 and the sidewall 90*b*. This narrow gap is adopted to store the greatest possible number of green compacts 95 inside the sintering case 9 simultaneously as efficiently as possible. This is because the narrower the gap, the greater the width of the sintering base plates 94 can be. In addition, when the gap between the sintering base plates 94 and the sidewall 90*b* is small, even if the sintering case 9 is vibrated during its transportation, for example, the sintering base plates 94 cannot move inside the sintering case 9 so much as to collapse the spacers 96 on the sintering base plates 94 unintentionally.

As shown in FIGS. 4A through 4C, each of the green compacts 95 has curved surfaces including a concave surface 95*a* and a convex surface 95*b*. When the green compact 95 shown in FIG. 4A is viewed along a plane that crosses the concave and convex surfaces 95*a* and 95*b* at right angles, the cross section of the compact 95 has a shape including two arcs. For example, the concave and convex surfaces 95*a* and 95*b* may constitute respective portions of two cylindrical surfaces having mutually different radii of curvature. In that case, the outer radius defined by the convex surface 95*b* may be greater than the inner radius defined by the concave surface 95*a*. A green compact having such a shape is called a "curved green compact" or an "arched green compact". As shown in FIG. 4A, this green compact 95 includes two curved surfaces (i.e., the concave and convex surfaces 95*a* and 95*b*, which will be herein also referred to as "principal surfaces") that are opposed to each other; two side surfaces 95*d* that are opposed to each other with the two curved surfaces 95*a* and 95*b* interposed between them; and two end surfaces 95*c* that cross both the curved surfaces 95*a* and 95*b* and the side surfaces 95*d* substantially at right angles. The principal surfaces 95*a* and 95*b* are greater in area than any of the other surfaces of the green compact 95. Typically, the end surfaces (or bottoms) 95*c* are smaller in area than any other surface of the green compact 95.

The green compacts 95 of such a shape are mounted on each of the sintering base plates 94 so as not to contact with each other, e.g., so that the horizontal edges of the concave surface 95*a* or the center of the convex surface 95*b* is in contact with the sintering base plate 94 as shown in FIGS. 4B and 4C. These arrangements are used to prevent the green compacts 95 from turning over in the manufacturing and processing step of mounting the green compacts 95 on the sintering base plate 94 or loading the sintering base plate 94 into the case 9, for example. For that purpose, the green compacts 95 are arranged to have their center of mass located at the lowest possible level (i.e., so that their top is located at the lowest possible level) when mounted on the sintering base plate 94. To increase the degree of orientation, the green compacts 95 (e.g., green compacts to be processed into R-T-(M)-B type magnets, in particular) have a green density that is lower than that of green compacts to be processed into ferrite magnets. The green compacts 95 to be processed into R-T-(M)-B magnets may have a green density of about 3.9 g/cm$^3$ to about 5.0 g/cm$^3$, for example. Accordingly, these green compacts 95 are very brittle and easily crack or chip on impact with something hard (e.g., the instant they fall or are dropped). Thus, these green compacts 95 should be arranged so as not to turn over so easily. It should be noted that the green compacts 95 arranged on the same sintering base plate 94 may have been either subjected to the compaction process individually or obtained by cutting and dividing a single green compact into multiple smaller bodies.

Furthermore, if the green compacts 95 that have been mounted directly on the sintering base plate 94 are sintered, then the resultant sintered bodies 95 and the sintering base plate 94 may sometimes be partially fused together unintentionally. This is because the rare earth element such as Nd included in the R-T-(M)-B type alloy powder and a metal element included in the sintering base plate 94 may cause a eutectic reaction at a temperature that is equal to or lower than the sintering temperature. If the base plate 94 and the sintered bodies 95 are partially fused together, the size of the green compacts 95 being sintered does not decrease smoothly with the sintering process, thus possibly cracking or chipping the resultant sintered bodies 95. Also, even if the base plate 94 and the sintered bodies 95 are not fused together, non-uniform friction may be created between the base plate 94 and the sintered bodies 95, thus also possibly cracking the sintered bodies 95 on their surface that is in contact with the sintering base plate 94.

Thus, to prevent the sintering base plate 94 and the sintered bodies 95 from being fused together, the surface of the sintering base plate 94 is coated with a bedding powder (not shown) according to a known technique so that the green compacts 95 can be sintered on the bedding powder (see, for example, Japanese Laid-Open Publication No. 4-154903). The bedding powder needs to be a powder of a material that exhibits low reactivity with the green compacts 95 and high chemical stability at an elevated temperature. When the green compacts 95 include a rare earth metal, the bedding powder may be a powder of a material exhibiting low reactivity with the rare earth metal, e.g., a powder of a rare earth oxide such as neodymium oxide or yttrium oxide. By using such a bedding powder, the sintering base plate 94 and the sintered bodies 95 are not fused together, and therefore, portions of the sintered bodies 95 that are in contact with the base plate 94 are neither damaged (e.g., cracked) nor deformed.

However, if multiple green compacts 95 are arranged inside the sintering case 9 as shown in FIGS. 3A and 3B, then the number of green compacts 95 that can be stored inside the sintering case 9 at the same time is relatively small, and the sintering process cannot be performed so efficiently. Specifically, when the flat-plate green compacts 95 are mounted so as to have their center of mass located at the lowest possible level, the projection area of each of those green compacts 95 on the base plate 94 is rather great, thus decreasing the number of green compacts 95 that can be arranged within a limited area. As used herein, the "projection area" of each green compact 95 means the area that is covered by the green compact 95 on the base plate 94.

Also, if the green compacts 95 are mounted as shown in FIG. 4B or 4C, each of these green compacts 95 is in contact with the base plate 94 in just a narrow area. Then, as the sintering process advances, the (frictional) stress that is created due to the shrinkage of the green compact 95 will be concentrated on the contact portions. In that case, even if the bedding powder is used as described above, the sintered body 95 is still damaged or deformed often by the frictional stress that is created.

Furthermore, when the green compact 95 is mounted as shown in FIG. 4C, portions located around the center of the convex surface 95*b* of the compact 95 are damaged or deformed. Thus, it is impossible to remove only the damaged or deformed portion of the sintered body 95 and use the remaining portion thereof. On the other hand, when the green compact 95 is mounted as shown in FIG. 4B, the concave surface 95*a* of the compact 95 has its horizontal edges deformed. This concave surface 95*a* has a shape that should not be deformed to fit the resultant sintered magnet on the rotor shaft of a motor. Accordingly, it is also difficult to remove only the deformed portions therefrom and process the remaining portion into a predetermined shape for a sintered magnet. That is to say, if any of the sintered bodies that have been mounted as shown in FIG. 4B or 4C becomes defective, then the defective sintered body cannot be used anymore, thus decreasing the yield of sintered magnets significantly.

On the other hand, Japanese Laid-Open Publication No. 61-125114 discloses a technique of reducing the number of defective (e.g., warped or deformed) sintered bodies in making relatively thin rare earth sintered magnets. According to the technique disclosed in Japanese Laid-Open Publication No. 61-125114, a green compact having a small thickness is sandwiched between a pair of thicker green compacts that is made of the same material, and has the same shape, as the former green compact. Also, according to the technique, a powder of a material that does not react with the green compacts easily is interposed between these green compacts and/or between the green compact and the base plate when needed.

In the method disclosed in Japanese Laid-Open Publication No. 61-125114, however, not only the thin green compact but also two other thicker green compacts should be prepared to obtain a single sintered body of the desired small thickness, thus decreasing the yield of the rare earth alloy powder material. Also, according to such a technique, it is difficult to increase the number of green compacts 95 that can be loaded into the sintering case 9 at the same time. Furthermore, in sintering the green compacts 95 having a shape such as that shown in FIG. 4A, it is difficult to sufficiently reduce the damage or deformation of the resultant sintered bodies 95 due to the frictional stress created by the shrinkage of the green compacts 95 being sintered. It is rather understandable that the frictional stress, which is created between the lowest one of the green compacts stacked and the base plate, would be increased to further damage or deform the resultant sintered body, because the total mass of the vertically stacked green compacts is applied to the lowest green compact that is in contact with the base plate.

As described above, the green compact of a rare earth alloy powder has a great specific gravity (e.g., a green compact of an R-T-(M)-B type alloy powder has a specific gravity of about 3.9 g/cm$^3$ or more) and is very brittle. Accordingly, when a frictional stress is created due to the shrinkage of the green compact being sintered (which loses as much as about 40% or more of its volume), the sintered body is easily damaged or deformed. Particularly when a green compact is mounted so as to have its center of mass located at a low level and to have a small area of contact with the base plate as shown in FIG. 4B or 4C, the resultant sintered body is damaged or deformed very easily. In addition, it is also difficult to store such green compacts efficiently inside a sintering case.

DISCLOSURE OF INVENTION

In order to overcome the problems described above, preferred embodiments of the present invention provide a method for producing rare earth sintered magnets that minimizes the number of damaged or deformed sintered bodies and greatly increases productivity.

A preferred embodiment of the present invention provides a method for producing rare earth sintered magnets. The method preferably includes the steps of pressing and compacting an alloy powder for the rare earth sintered magnets, thereby preparing a plurality of green compacts, arranging the green compacts on a receiving plane in a direction in which a projection area of each of the green compacts onto the receiving plane is not maximized, and heating the green compacts, thereby sintering the green compacts and obtaining a plurality of sintered bodies.

In one preferred embodiment of the present invention, the step of arranging the green compacts preferably includes the step of arranging the green compacts on the receiving plane in a direction in which the projection area of each of the green compacts onto the receiving plane is minimized.

In another preferred embodiment of the present invention, the step of pressing and compacting an alloy powder preferably includes the step of preparing a plurality of green compacts each having at least one curved surface, and the step of arranging the green compacts preferably includes the step of arranging the green compacts on the receiving plane so that the at least one curved surface of each of the green compacts crosses the receiving plane substantially at right angles.

In still another preferred embodiment, the step (a) preferably includes the step of preparing a plurality of green compacts each having: two principal surfaces that are opposed to each other; two side surfaces that are opposed to each other with the two principal surfaces interposed therebetween; and two end surfaces that cross both the principal surfaces and the side surfaces substantially at right angles. The step (b) preferably includes the step of arranging the green compacts on the receiving plane so that one of the two end surfaces of each of the green compacts contacts with the receiving plane.

In yet another preferred embodiment, the step of pressing and compacting an alloy powder preferably includes the step of pressing and compacting the alloy powder under an aligning magnetic field, and the step of arranging the green compacts preferably includes the step of arranging the green compacts on the receiving plane so that orientation directions of the alloy powder are substantially parallel to the receiving plane.

In yet another preferred embodiment, the step of pressing and compacting an alloy powder preferably includes the step of preparing the green compacts having a green density of about 4.1 g/cm$^3$ to about 4.5 g/cm$^3$.

In yet another preferred embodiment, the step arranging the green compacts preferably includes the step of arranging the green compacts on the receiving plane so that the green compacts are in contact with each other in a horizontal direction (which is typically substantially parallel to the thickness direction of the green compacts).

In this particular preferred embodiment, the step of arranging the green compacts preferably includes the step of arranging the green compacts, which have already been magnetized, on the receiving plane so that the green compacts attract each other via a magnetic force produced between the green compacts.

Alternatively or additionally, the step of arranging the green compacts may include the step of applying an anti-fusing agent to at least portions of the green compacts and arranging the green compacts on the receiving plane so that the green compacts come into contact with each other via the anti-fusing agent. Typically, the anti-fusing agent is applied to a portion of each of the green compacts.

Specifically, the anti-fusing agent preferably includes a powder of $Y_2O_3$. More specifically, the $Y_2O_3$ powder preferably has a mean particle size of about 1 $\mu$m to about 10 $\mu$m, more preferably about 3 $\mu$m to about 5 $\mu$m.

In this particular preferred embodiment, the step of arranging the green compacts preferably includes the step of applying slurry, in which the $Y_2O_3$ powder is dispersed in an organic solvent, to the portions of the green compacts.

In yet another preferred embodiment, the method may further include the step of removing a portion of each of the sintered bodies, which portion has been in contact with the receiving plane, and a surrounding portion thereof.

Another preferred embodiment of the present invention provides a sintered magnet for use in a motor. The magnet is preferably produced by the method according to any of the preferred embodiments of the present invention described above.

Other features, elements, characteristics, steps and advantages of the present invention will become more apparent from the following detailed description of preferred embodiments with reference to the attached drawings.

BRIEF DESCRIPTION OF DRAWINGS

FIGS. 4A, 4B and 4C illustrate what problems are caused by the known arrangement of the green compacts 95 in the sintering process step, wherein FIG. 4A is a perspective view of the green compact 95 to be processed into a sintered magnet for a motor, and FIGS. 4B and 4C are cross-sectional views schematically illustrating how the green compact 95 may be mounted on a base plate 94.

BEST MODE FOR CARRYING OUT THE INVENTION

Hereinafter, preferred embodiments of the present invention will be described as being applied to a method for producing R-T-(M)-B type sintered magnets for use in a motor, for example. It should be noted, however, that the present invention is not limited to the following specific preferred embodiments but is broadly applicable to a method for producing rare earth sintered magnets of any of various other types.

A method for producing rare earth sintered magnets according to various preferred embodiments of the present invention is mainly characterized by the manufacturing and processing step of sintering green compacts. Accordingly, the following description of preferred embodiments of the present invention will be focused on this sintering process step and the description of other manufacturing and processing steps, which may be carried out by known techniques, will be omitted herein.

A method for producing rare earth sintered magnets according to a preferred embodiment of the present invention preferably includes the steps of pressing and compacting an alloy powder for the rare earth sintered magnets, thereby preparing a plurality of green compacts, arranging the green compacts on a receiving plane in a direction in which a projection area of each of the green compacts onto the receiving plane is not maximized, and heating the green compacts, thereby sintering the green compacts and obtaining a plurality of sintered bodies.

In the step of arranging the green compacts, the green compacts are preferably stored in a case having the receiving plane. The sintering step preferably includes the step of heating the case, including the green compacts therein, in its entirety. When such a sintering case is used, the atmosphere for the sintering process step can be more uniform, for example.

Figure 3A:
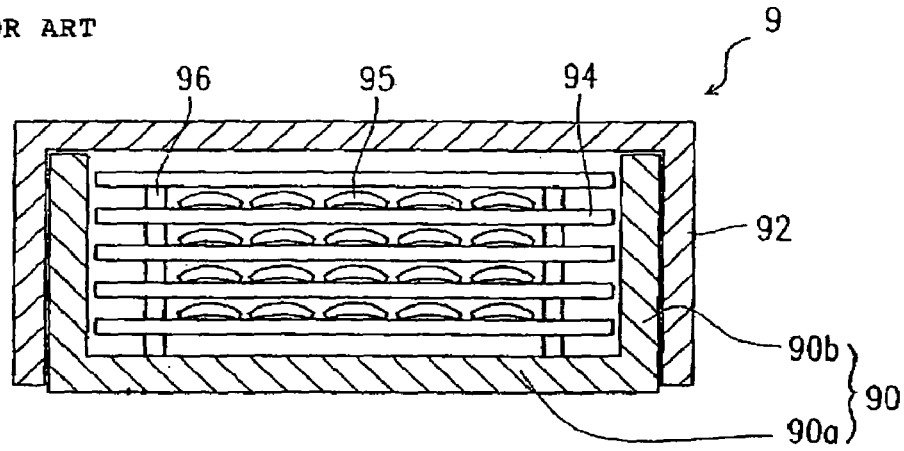
FIG. 3A PRIOR ART
FIGS. 3A and 3B are respectively a cross-sectional view and a plan view schematically illustrating a known arrangement of the green compacts 95 in a sintering process step of a conventional method for producing rare earth sintered magnets.
Figure 3B:
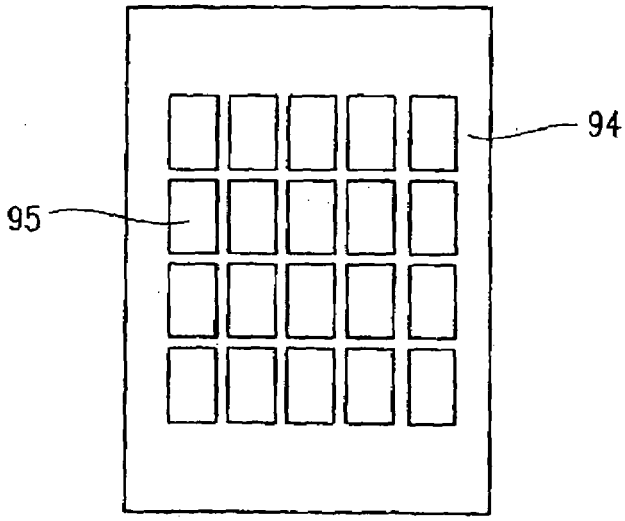
FIG. 3B PRIOR ART

In this method, the step of arranging the green compacts may be carried out by using the sintering case 9 shown in FIGS. 3A and 3B, for example. In the drawings to be referred to in the following description, each member having substantially the same function as the counterpart shown in FIG. 3A, 3B, 4A, 4B or 4C will be identified by the same reference numeral and the description thereof will be omitted herein.

Figure 1A:
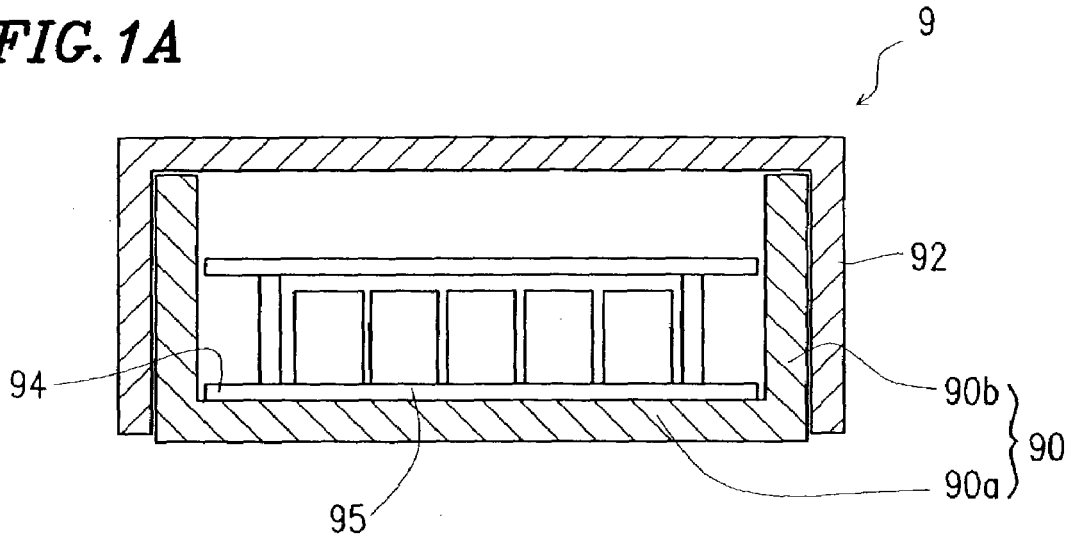
FIGS. 1A and 1B are respectively a cross-sectional view and a plan view schematically illustrating how green compacts 95 may be arranged in a sintering process step of a method for producing rare earth sintered magnets according to a preferred embodiment of the present invention.
Figure 1B:
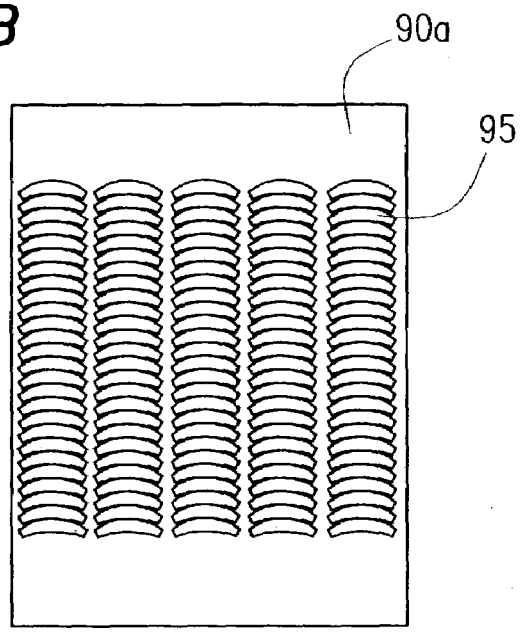
Figure 2:
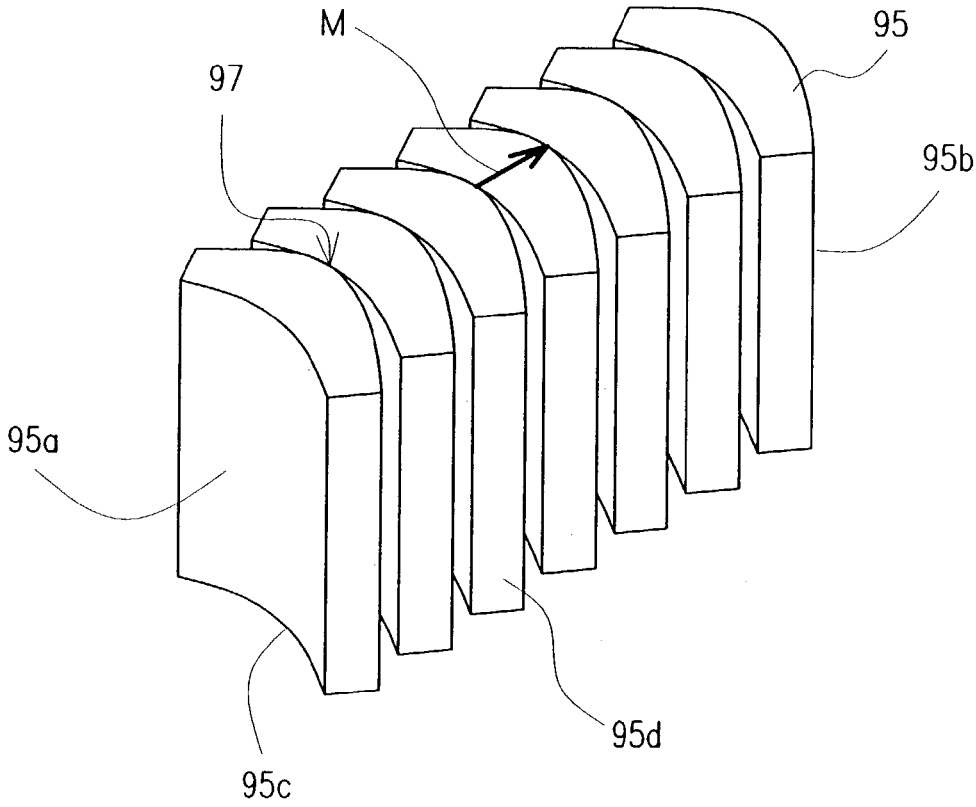
FIG. 2 is a perspective view illustrating how adjacent ones of the green compacts 95 shown in FIGS. 1A and 1B may be arranged.

In one preferred embodiment of the present invention, the green compacts 95 to be processed into sintered magnets for a motor may be arranged as shown in FIGS. 1A, 1B and 2.

In this preferred embodiment, the green compacts 95 may have an outer diameter of about 22.13 mm, a width of about 26.14 mm, a thickness of about 9.73 mm and a height of about 45 mm in the arrangement shown in FIGS. 1A and 1B, for example. In the sintering case 9, the bottom plate (i.e., the flat-plate portion) 90*a* of the bottom container 90 thereof may have approximate dimensions of 270 mm×305 mm×1 mm (thickness), while the cover 92 thereof may have approximate outer dimensions of 280 mm×315 mm×70 mm (height) and a thickness of about 1.5 mm, for example. The bottom container 90 and the cover 92 may be made of a material that can resist the heat generated in the sintering and other process steps, e.g., stainless steel or a refractory metal such as molybdenum. For example, the sintering case 9 may be made of SUS310. In that case, the case 9 is not deformed due to the heat so much as a case 9 made of SUS304.

In the preferred embodiment illustrated in FIGS. 1A and 1B, the green compacts 95 are arranged on the sintering base plate 94 that has been mounted on the bottom plate 90*a* of the bottom container 90. Alternatively, the sintering base plate 94 may be omitted and the green compacts 95 may be mounted directly on the bottom plate 90*a* of the bottom container 90. That is to say, either the surface of the base plate 94 or that of the bottom plate 90*a* functions as a surface that receives the green compacts 95 thereon. The sintering base plate 94 is preferably used because a large number of green compacts 95 can be arranged thereon easily. The sintering base plate 94 may have approximate dimensions of 250 mm×300 mm×1 mm (thickness), for example. The sintering base plate 94 is preferably made of molybdenum. This is because molybdenum has low reactivity with the green compacts and exhibits good thermal conductivity and thermal resistance. The receiving plane of this sintering base plate 94 preferably has an average surface roughness Ra of about 1 $\mu$m to about 50 $\mu$m.

Figure 4A:
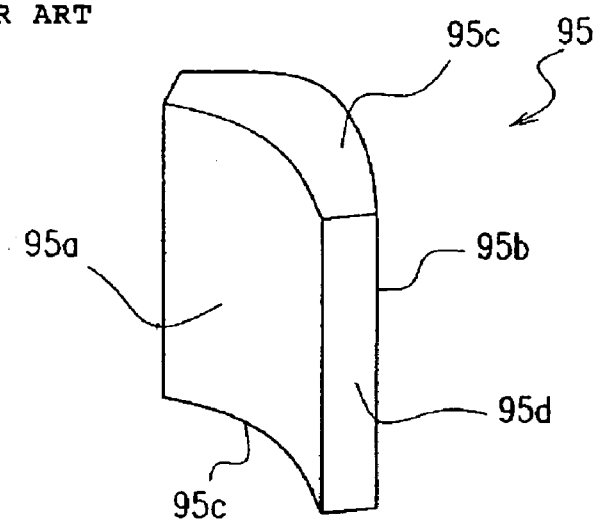
FIG. 4A PRIOR ART
Figure 4B:
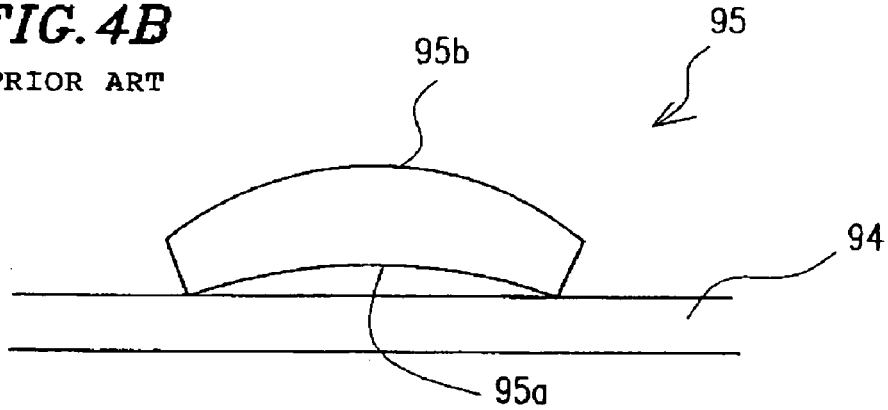
FIG. 4B PRIOR ART

In this preferred embodiment, the green compacts 95 are arranged on the base plate 94 in a direction in which the projection area of each of the green compacts 95 onto the base plate 94 is minimized, unlike the arrangement shown in FIGS. 4A and 4B. According to such an arrangement, a greater number of green compacts 95 can be arranged within the same limited area. Naturally, it is most efficient to arrange the green compacts 95 in the direction in which the projection area of each green compact 95 onto the base plate 94 is minimized. However, the green compacts 95 may also be arranged in any other direction as long as the projection area of each green compact 95 onto the base plate 94 is not maximized. This is because unless the projection area is maximized, the projection area decreases to a certain degree and the green compacts 95 can be stored in the case 9 more efficiently. If the green compacts 95 having a substantially flat-plate shape are arranged so as to have their center of mass located at a low level as in the prior art, then the projection area of each green compact 95 onto the base plate 94 is maximized as described above. In contrast, in this preferred embodiment of the present invention, the green compacts 95 are arranged so as to have minimized projection areas.

Figure 4C:
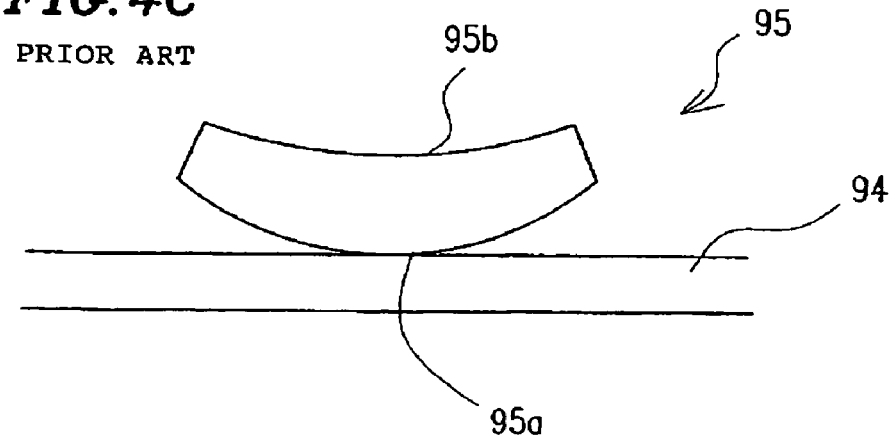
FIG. 4C PRIOR ART

When these green compacts 95 have curved surfaces (i.e., the concave surface 95*a* and convex surface 95*b*) like the green compacts 95 to be processed into sintered magnets for use in a motor, the green compacts 95 are preferably arranged so that their curved surface(s) 95*a* and/or 95*b* cross(es) the surface of the base plate 94 substantially at right angles. As shown in FIGS. 4A, 4B and 4C, the green compact 95 has a substantially flat-plate shape and the curved surfaces 95*a* and 95*b* as its opposed principal surfaces. If such a green compact 95 is mounted on the base plate 94 so that the curved surface 95*a* or 95*b* thereof is opposed to the surface of the base plate 94, then the area of contact between the green compact 95 and the base plate 94 is small, a greater frictional stress is created due to the shrinkage of the green compact 95 being sintered and the resultant sintered body is damaged or deformed to a greater degree as already described with reference to FIGS. 4B and 4C. In contrast, if the green compact 95 is mounted on the base plate 94 so that a flat surface thereof (e.g., the bottom 95*c*) is in contact with the surface of the base plate 94 as shown in FIGS. 1A, 1B and 2, then the area of contact between the green compact 95 and the base plate 94 increases and a smaller frictional stress is created due to the shrinkage of the green compact 95 being sintered. Furthermore, the amount of maximum shrinkage in the contact area between the green compact 95 and the base plate 94 (i.e., the maximum value of one-dimensional lengths decreasing) is smaller than the arrangement shown in FIGS. 3A and 3B. Thus, the frictional stress decreases because of this reason also. To prevent the green compact 95 and the base plate 94 from being fused together unintentionally, a bedding powder is preferably interposed between the green compact 95 and the base plate 94.

However, if the green compact 95 is mounted on the base plate 94 with its bottom 95*c* facedown as shown in FIG. 2, then the green compact 95 will have a center of mass located at a higher level and will fall down more easily. Also, in that case, it is much more troublesome to arrange a great number of green compacts 95 in such a position. The quasi-flat-plate green compact 95 illustrated in FIG. 2 falls down particularly easily. This is because its center of mass easily shifts from its bottom 95*c* even when the green compact 95 leans only slightly. Accordingly, where the green compacts 95 should be mounted on the base plate 94 with their bottom 95*c* facedown, the green compacts 95 are preferably arranged thereon so as to come into contact with each other horizontally (typically, in a direction that is substantially parallel to the surface of the base plate 94 and substantially parallel to the thickness direction of the green compacts 95).

Particularly if the green compacts 95 have been magnetized (e.g., if the green compacts 95 have acquired remanent magnetization during the compaction process carried out under a magnetic field), then the green compacts 95 attract each other via a magnetic force produced between them. As a result, the green compacts 95 can be arranged in a row stably. The green compacts 95 to be processed into sintered magnets for use in a motor acquire remanent magnetization M while being subjected to a compaction process under an aligning magnetic field, and attract each other via the remanent magnetization M as shown in FIG. 2. The magnitude of the remanent magnetization M (i.e., remanence) is preferably from about 0.002 T to about 0.006 T. The green compact, which has been obtained by compacting a material alloy powder under an aligning magnetic field to make an anisotropic sintered magnet as described above, is preferably demagnetized incompletely so as to retain a certain degree of remanent magnetization.

Also, as shown in FIG. 2, the direction of the remanent magnetization M (which will be herein also referred to as the "orientation direction" of the green compacts or alloy powder) is preferably substantially parallel to the direction in which the green compacts 95 are arranged, i.e., a substantially horizontal direction (typically, substantially parallel to the surface of the base plate 94). The green compacts 95 exhibit anisotropic magnetic properties. Accordingly, the green compacts 95 being sintered shrink at a relatively high rate in a direction that is substantially parallel to the magnetization direction thereof. For that reason, to minimize the amount of shrinkage, which is obtained by multiplying the shrinkage rate by the length, the green compacts 95 have preferably been magnetized in a direction defined by the shortest one of the three dimensions of the green compacts 95. For example, the quasi-flat-plate green compacts 95 have preferably been magnetized in the thickness direction as shown in FIG. 2. However, the direction of the remanent magnetization M is not limited to the thickness direction but may be any other direction as long as the green compacts 95 can be magnetized in such a manner as to attract each other. For instance, if the green compacts 95 to be arranged as shown in FIG. 2 have been magnetized in the height direction (i.e., vertically), then the green compacts 95 may be arranged in such a manner as to alternate their magnetization directions in the direction in which the green compacts 95 are arranged, i.e., so that the magnetization direction of one of the green compacts 95 is opposite to that of a horizontally adjacent one of them. Then, the green compacts 95 can also attract each other.

On the other hand, if there is no need to apply any aligning magnetic field during the process step of preparing the green compacts (e.g., in making green compacts for isotropic magnets), a magnetic field may also be applied afterward to the as-pressed, green compacts 95 so that the green compacts 95 will have a remanence falling within the range specified above.

It should be noted that to arrange the green compacts 95 as stably as possible, the number of green compacts 95 that make up each row is preferably determined appropriately in accordance with the shape of the green compacts 95 to be obtained. More specifically, to increase the stability of the row of green compacts 95, the number of green compacts 95 to be in contact with each other needs to be large enough to prevent the center of mass of the row of green compacts 95 from shifting from the bottom of the row so easily even if the row is vibrated or leaned to an expected degree.

If the green compacts 95 are arranged so as to be adjacent to each other, then the green compacts 95 might be fused together unintentionally during the sintering process. To avoid this unwanted situation, an anti-fusing agent is preferably applied to at least those portions where the green compacts 95 are in contact with each other. That is to say, the green compacts 95 are preferably in contact with each other with the anti-fusing agent interposed between them.

Just like the conventional bedding powder, the anti-fusing agent is also preferably made of a material exhibiting low reactivity with the green compacts 95, e.g., a rare earth oxide. Among other things, the anti-fusing agent preferably includes a powder of $Y_2O_3$. This is because $Y_2O_3$ exhibits high chemical stability and is hardly reduced while the green compacts of a rare earth alloy powder are sintered. The $Y_2O_3$ powder preferably has a mean particle size of about 1 $\mu$m to about 10 $\mu$m, and more preferably about 3 $\mu$m to about 5 $\mu$m.

The anti-fusing agent may be applied to the predetermined portions of the green compacts 95 by coating those portions with slurry in which the anti-fusing agent (e.g., a powder of $Y_2O_3$) is dispersed in an organic solvent. The organic solvent is preferably a solvent having a high degree of volatility, e.g., a hydrocarbon based solvent such as isoparaffin or a lower alcohol based solvent such as ethanol. When a powder of $Y_2O_3$ is used as the anti-fusing agent, slurry in which the $Y_2O_3$ powder is dispersed at a concentration of about 20 g/l in isoparaffin may be applied with a brush or a spray. If the slurry has such a concentration, the unwanted fusing can be prevented sufficiently by applying the slurry to those portions just once with a brush. If necessary, the slurry may have its concentration changed (e.g., within a range of about 10 g/l to about 800 g/l) or applied a greater number of times.

Optionally, the green compacts 95 may be immersed in the slurry. However, this technique is not preferable because a lot of organic solvent must be absorbed into the green compacts 95 to increase the amount of carbon that will remain in the resultant sintered bodies. For that reason, the anti-fusing agent is preferably applied selectively to the predetermined portions of the green compacts 95 by brushing those portions over, for example. In addition, when the easily volatilizable slurry having a concentration falling within the above-specified range is used, no drying process step has to be performed.

For example, in the conventional arrangement shown in FIGS. 3A and 3B, only 100 green compacts 95 can be mounted on four base plates 94 (i.e., 25 green compacts 95 per base plate) inside the sintering case 9 that accommodates the base plates 94 having approximate dimensions of 300 mm×260 mm. In contrast, according to the arrangement shown in FIGS. 1A and 1B, as many as 130 green compacts 95 can be mounted on a single base plate 94. In the arrangement shown in FIGS. 1A and 1B, the gap between two adjacent rows of green compacts 95 is preferably about 10 mm or more and the gap between the inner walls of the sintering case 9 and the green compact rows is preferably about 20 mm or more. These gaps are left to allow the worker to mount the green compacts 95 on the base plate 94 easily enough, and may be changed if necessary.

According to the arrangement of this preferred embodiment, the green compacts 95 can be arranged inside the sintering case 9 much more efficiently than the conventional arrangement. In addition, the frictional stress created by the green compacts 95 being sintered can also be reduced, thus minimizing the damage or deformation of the resultant sintered bodies.

However, depending on the shape, size or orientation direction of the green compacts 95, the sintered bodies 95 might be warped around the bottom 95*c* thereof. For example, if the green compacts 95 are either relatively tall or oriented in the height direction (i.e., vertically), then the green compacts 95 may shrink to a greater degree in the height direction. Or the bottom 95*c* and surrounding portion of the green compacts 95 may have their vertical cross-sectional shape deformed into a trapezoidal shape due to their own weight. For example, when a pressure of approximately 20 g/cm$^2$ or more is applied on the bottom 95*c* of the green compacts 95, the green compacts 95 may be deformed there. In that situation, the green compacts 95 are crushed so to speak, and have a broadened bottom 95*c*. Nevertheless, if the green compacts 95 are arranged as is done in this preferred embodiment, just the bottom 95*c* and surrounding portion of the green compacts 95 are deformed as described above. Thus, by removing (e.g., cutting or grinding away) only those deformed portions, for example, the remaining portion of the sintered bodies 95 still can be used, thus increasing the yield of the material (or sintered bodies). When it is expected that it would be difficult to avoid such deformation considering the selected shape of the green compacts 95, the green compacts 95 may be formed to have a greater size than required so as to easily cope with the deformation by removing the unnecessary, deformed portions therefrom. In this manner, sintered bodies of a desired size can also be obtained.

In the example illustrated in FIGS. 1A, 1B and 2, the green compacts 95 are arranged on the base plate 94 so as to have their bottom 95*c* contact with the base plate 94. Alternatively, depending on the shape of the green compacts 95, the green compacts 95 may also be arranged there so as to have their side surface 95*d* contact with the base plate 94. However, it is still most preferable to arrange the green compacts 95 on the base plate 94 with their bottom 95*c* facedown so that the projection area of each green compact 95 onto the base plate 94 is minimized.

Thus, according to various preferred embodiments of the present invention described above, sintered bodies can be obtained at a much higher yield and sintered magnets for use in a motor, for example, can be produced much more efficiently. The method for producing rare earth sintered magnets according to preferred embodiments of the present invention can be used particularly effectively to prepare sintered bodies in a shape that is very similar to that of the sintered magnets to be obtained finally.

In the preferred embodiments described above, the green compacts to be processed into sintered magnets for use in a motor, for example, have inner and outer curved surfaces with mutually different radii of curvature. However, it is naturally possible to apply the present invention to green compacts having inner and outer curved surfaces with approximately equal radii of curvature. Even in such an alternative preferred embodiment, the area of contact between each green compact and the receiving plane of the sintering case is also smaller than the area of contact between two adjacent green compacts. Furthermore, the present invention is equally applicable to a thin-plate green compact, which has a substantially rectangular parallelepiped shape (e.g., for an IMP motor) and in which the powder is oriented in the thickness direction of the green compact.

In the preferred embodiments described above, the green compacts are arranged on the horizontal receiving plane of the sintering case so that the bottom of those green compacts (i.e., a plane that is in contact with the receiving plane of the sintering case) and a plane on which the green compacts are in contact with each other (i.e., a side surface of the green compacts) cross at right angles. However, the present invention is not limited to those specific preferred embodiments. For example, where the bottom of the green compacts is tilted, i.e., when the bottom of the green compacts and the plane on which the green compacts are in contact with each other (i.e., the side face of the green compacts) do not cross at right angles, a sintering case, having a receiving plane that defines such an angle as to bring the green compacts into contact with each other horizontally, may be used. For example, such a receiving plane may be the rugged surface of a base plate having a sawtooth cross section. Then, the green compacts can also be arranged on the receiving plane stably.

A rare earth alloy powder for use in the method for producing rare earth sintered magnets according to preferred embodiments of the present invention is not particularly limited. For example, an R-T-(M)-B type rare earth alloy powder as disclosed in U.S. Pat. No. 4,770,723 or No. 4,792,368 may be used. An R-T-(M)-B type rare earth alloy powder, prepared by a strip casting process as disclosed in U.S. Pat. No. 5,383,978, for example, is particularly preferred to achieve good magnetic properties. The contents of U.S. Pat. Nos. 4,770,723, 4,792,368 and 5,383,978 identified above are hereby incorporated by reference. The compacting process may be performed by any of various known techniques. The green density is normally about 3.9 g/cm$^3$ to about 5.0 g/cm$^3$ and is often about 4.1 g/cm$^3$ to about 4.4 g/cm$^3$.

To achieve sufficiently good magnetic properties and compactability, the rare earth alloy powder for use to produce a rare earth sintered magnet according to a preferred embodiment of the present invention preferably has a mean particle size (i.e., FSSS particle size) of about 2 $\mu$m to about 10 $\mu$m, more preferably about 3 $\mu$m to about 6 $\mu$m. Also, the green density is preferably about 4.1 g/cm$^3$ to about 4.5 g/cm$^3$. The reason is as follows. If the green density is lower than about 4.1 g/cm$^3$, then the green compacts being sintered might be deformed considerably. On the other hand, if the green density exceeds about 4.5 g/cm$^3$, then the magnetic powder will exhibit a decreased degree of orientation. The vertical length (i.e., the height) of the green compacts arranged on the base plate is preferably at most about 70 mm. The arrangement adopted in the preferred embodiments of the present invention is particularly effective when the height is about 25 mm or more.

After having been stored in the sintering case 9 in the above-described manner, the green compacts 95 are sintered by heating the sintering case 9 in its entirety. The sintering process may also be performed by a known technique and the conditions thereof may be optimized in accordance with the type of the rare earth sintered magnets to be produced. For example, the green compacts 95 may be sintered through the following manufacturing and processing steps.

First, at least the sintering case 9 is loaded into a preparation chamber, which is provided at the inlet of a sintering apparatus, and then the preparation chamber is sealed hermetically. Next, the preparation chamber is evacuated to a pressure of about 2 Pa for antioxidizing purposes.

Then, the sintering case 9 is transported to a burn-off chamber, where the green compacts 95 are subjected to a binder removal process for approximately 1 to 6 hours at a temperature of about 100° C. to about 600° C. and at a pressure of about 2 Pa. The binder removal process is performed to volatilize and remove the lubricant (or binder), covering the surface of the magnetic powder, before the powder is sintered. To improve the orientation of the magnetic powder during the compaction process, the lubricant was mixed with the magnetic powder before the powder is pressed and compacted. The lubricant is present between the particles of the magnetic powder.

After the binder removal process is finished, the sintering case 9 is transported to a sintering chamber, where the green compacts 95 are sintered at about 1,000° C. to about 1,100° C. for approximately 2 to 5 hours within a reduced pressure atmosphere (e.g., an Ar gas having a pressure of about 2 Pa). Thereafter, the sintering case 9 is transported to a cooling chamber, where the sintered bodies are cooled until the temperature of the sintering case 9 reaches approximately room temperature.

Finally, the sintering case 9 is unloaded from the cooling chamber and then loaded into an aging treatment furnace, where the sintered bodies are subjected to a normal aging treatment. The aging treatment may be conducted at a temperature of about 400° C. to about 600° C. for approximately 1 to 5 hours within an inert atmosphere (e.g., argon) at about 2 Pa.

INDUSTRIAL APPLICABILITY

Various preferred embodiments of the present invention described above provide a method for producing rare earth sintered magnets that minimizes the number of damaged or deformed sintered bodies and greatly increases productivity. Also, even if any sintered bodies have been partially deformed, the deformed portions may be removed and the remaining portion still may be used, thus increasing the yield of the material advantageously. The method for producing rare earth sintered magnets according to preferred embodiments of the present invention can be used particularly effectively to produce quasi-flat-plate sintered magnets having curved surfaces for use in a motor, for example.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

The invention claimed is:

1. A method for producing rare earth sintered magnets, the method comprising the steps of:

(a) pressing and compacting an alloy powder for the rare earth sintered magnets, thereby preparing a plurality of green compacts;

(b) arranging the green compacts on a receiving plane in a direction in which a projection area of each said green compact onto the receiving plane is not maximized; and (c) heating the green compacts within a reduced-pressure atmosphere, thereby sintering the green compacts and obtaining a plurality of sintered bodies; wherein step (b) includes the step of arranging the green compacts on the receiving plane so that the green compacts are in contact with each other in a horizontal direction; and step (b) includes the step of applying an anti-fusing agent composed of a slurry in which a $Y_2O_3$ powder is dispersed in an organic solvent to at least portions of the green compacts and arranging the green compacts on the receiving plane so that the green compacts are in contact with each other via the anti-fusing agent.

2. The method of claim 1, wherein the step (b) includes the step of arranging the green compacts on the receiving plane in a direction in which the projection area of each said green compact onto the receiving plane is minimized.

3. The method of claim 1, wherein the step (a) includes the step of preparing a plurality of green compacts each having at least one curved surface, and wherein the step (b) includes the step of arranging the green compacts on the receiving plane so that the at least one curved surface of each said green compact crosses the receiving plane substantially at right angles.

4. The method of claim 1, wherein the step (a) includes the step of preparing a plurality of green compacts each having: two principal surfaces that are opposed to each other; two side surfaces that are opposed to each other with the two principal surfaces interposed therebetween; and two end surfaces that cross both the principal surfaces and the side surfaces substantially at right angles, and wherein the step (b) includes the step of arranging the green compacts on the receiving plane so that one of the two end surfaces of each of said green compacts contacts with the receiving plane.

5. The method of claim 1, wherein the step (a) includes the step of pressing and compacting the alloy powder under an aligning magnetic field, and wherein the step (b) includes the step of arranging the green compacts on the receiving plane so that orientation directions of the alloy powder are substantially parallel to the receiving plane.

6. The method of claim 1, wherein the step (a) includes the step of preparing the green compacts having a green density of about 4.1 g/cm$^3$ to about 4.5 g/cm$^3$.

7. The method of claim 1, wherein the step (b) includes the step of arranging the green compacts, which have already been magnetized, on the receiving plane so that the green compacts attract each other via a magnetic force produced between the green compacts.

8. The method of claim 1, wherein the $Y_2O_3$ powder has a mean particle size of about 1 $\mu$m to about 10 $\mu$m.

9. A method for producing rare earth sintered magnets, the method comprising the steps of:

(a) pressing and compacting an alloy powder for the rare earth sintered magnets, thereby preparing a plurality of green compacts;

(b) arranging the green compacts on a receiving plane in a direction in which a projection area of each said green compact onto the receiving plane is not maximized;

(c) heating the green compacts within a reduced-pressure atmosphere, thereby sintering the green compacts and obtaining a plurality of sintered bodies; and (d) removing a portion of each said sintered bodies, which portion has been in contact with the receiving plane, and a surrounding portion thereof.

* * * * *